US006663516B2

(12) United States Patent
Severa et al.

(10) Patent No.: US 6,663,516 B2
(45) **Date of Patent: *Dec. 16, 2003**

(54) GAME RACQUET WITH SEPARATE HEAD AND HANDLE PORTIONS FOR REDUCING VIBRATION

(75) Inventors: William D. Severa, West Chicago, IL (US); Po-Jen Cheng, Oak Brook, IL (US); Gerald J. Le Vault, Addison, IL (US); Michael R. Moon, Chicago, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/277,672

(22) Filed: Oct. 22, 2002

(65) Prior Publication Data

US 2003/0036448 A1 Feb. 20, 2003

Related U.S. Application Data

(63) Continuation of application No. 09/849,965, filed on May 4, 2001, now Pat. No. 6,500,080.

(51) Int. Cl.[7] ..... A63B 49/02

(52) U.S. Cl. ..... 473/521; 473/546

(58) Field of Search ..... 473/520, 521, 473/524, 531, 532, 546

(56) References Cited

U.S. PATENT DOCUMENTS

| | | | | | |
|---|---|---|---|---|---|
| 4,139,194 | A | * | 2/1979 | Fischer | 473/521 |
| 4,367,871 | A | * | 1/1983 | Schiefer | 403/294 |
| 5,071,125 | A | * | 12/1991 | Shen | 473/521 |
| 5,178,387 | A | * | 1/1993 | Kuebler | 473/523 |
| 5,236,198 | A | * | 8/1993 | Haines et al. | 473/318 |
| 5,524,884 | A | * | 6/1996 | Haines | 473/520 |
| 6,500,080 | B2 | * | 12/2002 | Severa et al. | 473/521 |

FOREIGN PATENT DOCUMENTS

| | | | | |
|---|---|---|---|---|
| DE | 3521621 | * | 1/1986 | 473/FOR 183 |
| FR | 2590802 | * | 6/1987 | 473/FOR 183 |
| GB | 2230458 | * | 10/1990 | 473/FOR 178 |

* cited by examiner

*Primary Examiner*—Ralelgh W. Chiu

(57) ABSTRACT

A game racquet includes separate head and handle portions which are separated by shock and/or vibration absorbing material. Both the head portion and the handle portion are bonded to the absorbing material and are thereby connected to each other.

28 Claims, 11 Drawing Sheets

GAME RACQUET WITH SEPARATE HEAD AND HANDLE PORTIONS FOR REDUCING VIBRATION

RELATED U.S. APPLICATION DATA

The present application is a continuation of U.S. patent application Ser. No. 09/849,965, entitled "Game Racquet With Separate Head And Handle Portions For Reducing Vibration," filed on May 4, 2001 by Severa et al now U.S. Pat. No. 6,500,080.

BACKGROUND

This invention relates to game racquets, and, more particularly, to a game racquet with separate head and handle portions which are separated by, and joined with, shock and/or absorbing material.

Game racquets such as tennis racquets, racquetball racquets, and squash racquets include a head portion and a handle portion. The head portion supports a string bed, and the player holds the racquet by the handle portion.

When the head portion strikes a ball, shock and vibration are transmitted from the head portion through the handle portion to the player's arm. Such shock and vibration can cause discomfort and can lead to physical problems such as tendinitis or tennis elbow.

Shock is caused by the impact of a ball on the strings. Shock on a typical tennis racquet might last about 3 milliseconds after ball impact.

Vibration is caused by shock and lasts longer. Vibration might last about 1000 milliseconds in a typical tennis racquet.

Many prior attempts have been made to reduce the transmission of shock and vibration to the player's arm. However, any direct connection between the head portion and the handle portion can provide an area through which shock and vibration can be transmitted. A conventional one-piece racquet acts as a conduit of vibration from the head to the handle.

U.S. Pat. No. 4,609,198 describes a racquet in which a tubular damping pad is positioned within the grip of the racquet.

SUMMARY OF THE INVENTION

The invention provides a game racquet with separate head and handle portions The handle portion includes arms which extend along portions of the head, and the head and handle portions are separated by, and joined with, shock and/or vibration absorbing material such as urethane or rubber which reduces the transmission of shock and vibration from the head portion to the handle portion.

The head and handle portions are advantageously joined to the shock and/or vibration absorbing material by adhesive or an adhesive agent. If desired, an additional mechanical connection between the head and handle portions can be provided, for example, by strings which extend through string holes in both the head and the handle portions.

The shock and/or vibration absorbing material is advantageously urethane, natural rubber, butyl rubber, or synthetic rubber and has a Shore A hardness within the range of 0 to 90, more preferably within the range of 20 to 70, and most preferably within the range of 30 to 60. Other relatively soft polymeric materials could also be used.

DESCRIPTION OF THE DRAWING

The invention will be explained in conjunction with the attached drawing, in which.

DESCRIPTION OF SPECIFIC EMBODIMENTS

Figure 1:
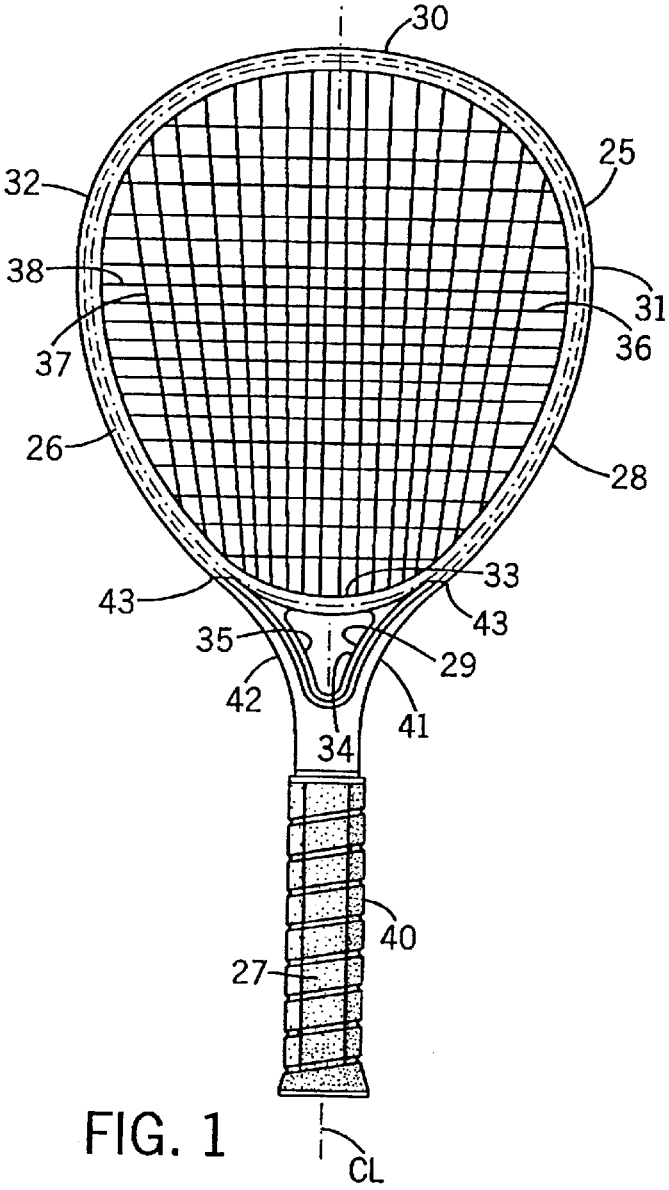
FIG. 1 is a front view of one embodiment of a game racquet which is formed in accordance with the invention.
Figure 2:
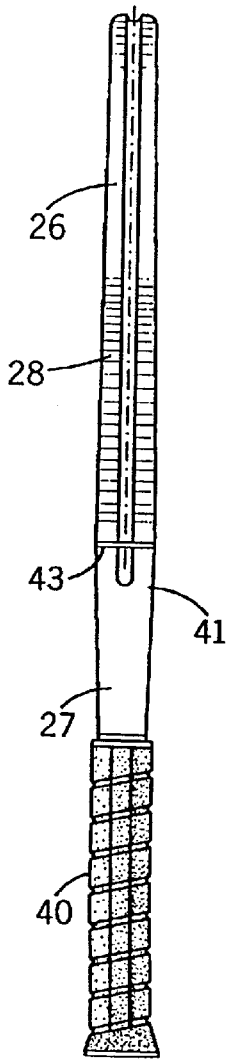
FIG. 2 is a side view of the racquet of FIG. 1.

Referring to FIGS. 1 and 2, a tennis racquet 25 includes a head portion 26 and a handle portion 27. The handle is aligned with a longitudinal centerline CL of the racquet. Although the invention will be explained with reference to a tennis racquet, it will be understood that the invention can be used with other game racquets such as racquetball racquets and squash racquets.

The head and handle portions can be formed from any conventional material for game racquets. For example, either or both of the head and handle portions could be made from thermoplastic or thermoset materials or a combination of thermoplastic and thermoset materials. The preferred material is a graphite and resin composite. The head and handle portions can be formed from the same or different materials.

The head portion includes a hoop 28 and a generally V-shaped throat portion 29. The hoop includes a top portion 30, side portions 31 and 32, and a bottom or yoke portion 33. The throat includes a pair of arms 34 and 35 which converge downwardly and inwardly from the sides of the hoop.

A string bed 36 is supported by the hoop 28 in the conventional manner. The string bed includes longitudinally extending main strings 37 and cross strings 38.

The handle portion 27 includes a grip portion 40 which is wrapped with grip material and a throat portion which is formed from a pair of arms 41 and 42 which diverge outwardly and upwardly from the grip portion. Each arm includes an upper end 43 which is adjacent the juncture between the yoke 33 and the sides 31 and 32 of the hoop.

As will be explained in detail with respect to the embodiment illustrated in FIG. 3, material which absorbs shock and/or vibration is positioned between the head and handle portions and isolates the head and handle portions. Each of the head and handle portions is attached to the shock and/or vibration absorbing material, advantageously by adhesive or an adhesive agent, and the head and handle are thereby connected to each other.

Figure 3:
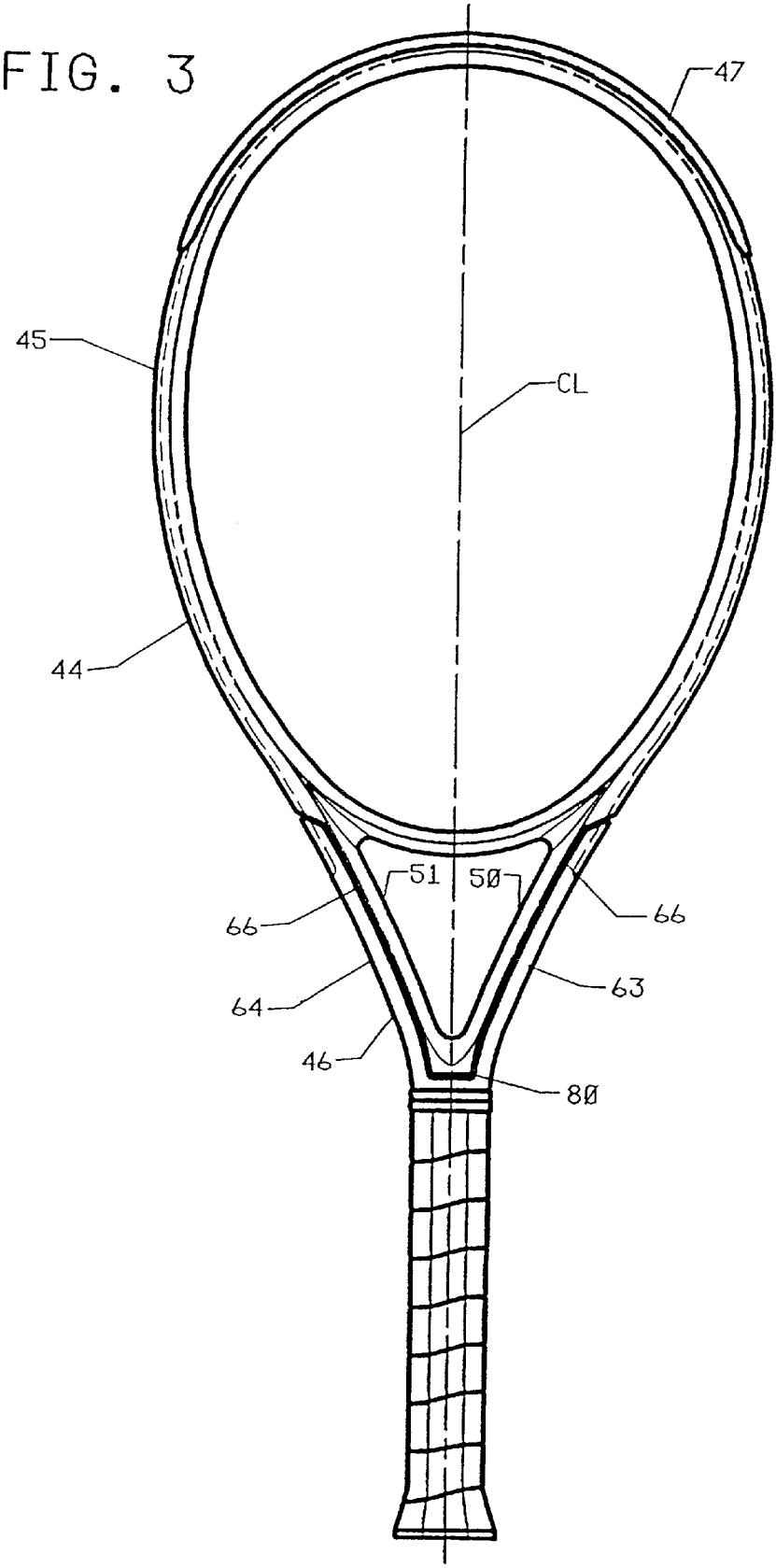
FIG. 3 is a front view of another embodiment of a racquet which is formed in accordance with the invention.
Figure 4:
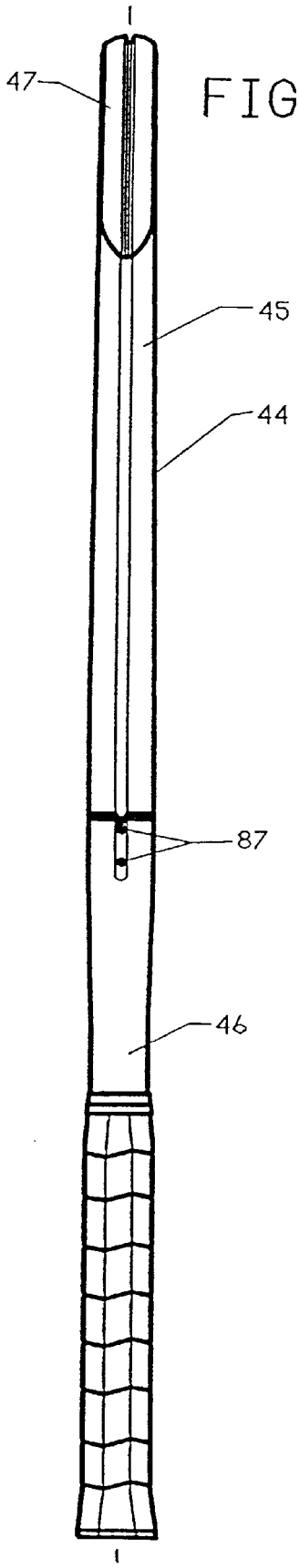
FIG. 4 is a side view of the racquet of FIG. 3.

FIGS. 3 and 4 illustrate another embodiment of a racquet 44 which is similar to the racquet 25. The racquet 44 includes a head portion 45 and a handle portion 46 which extends along the centerline CL of the racquet A bumper strip 47 can protect the top of the head portion if desired.

Figure 5:
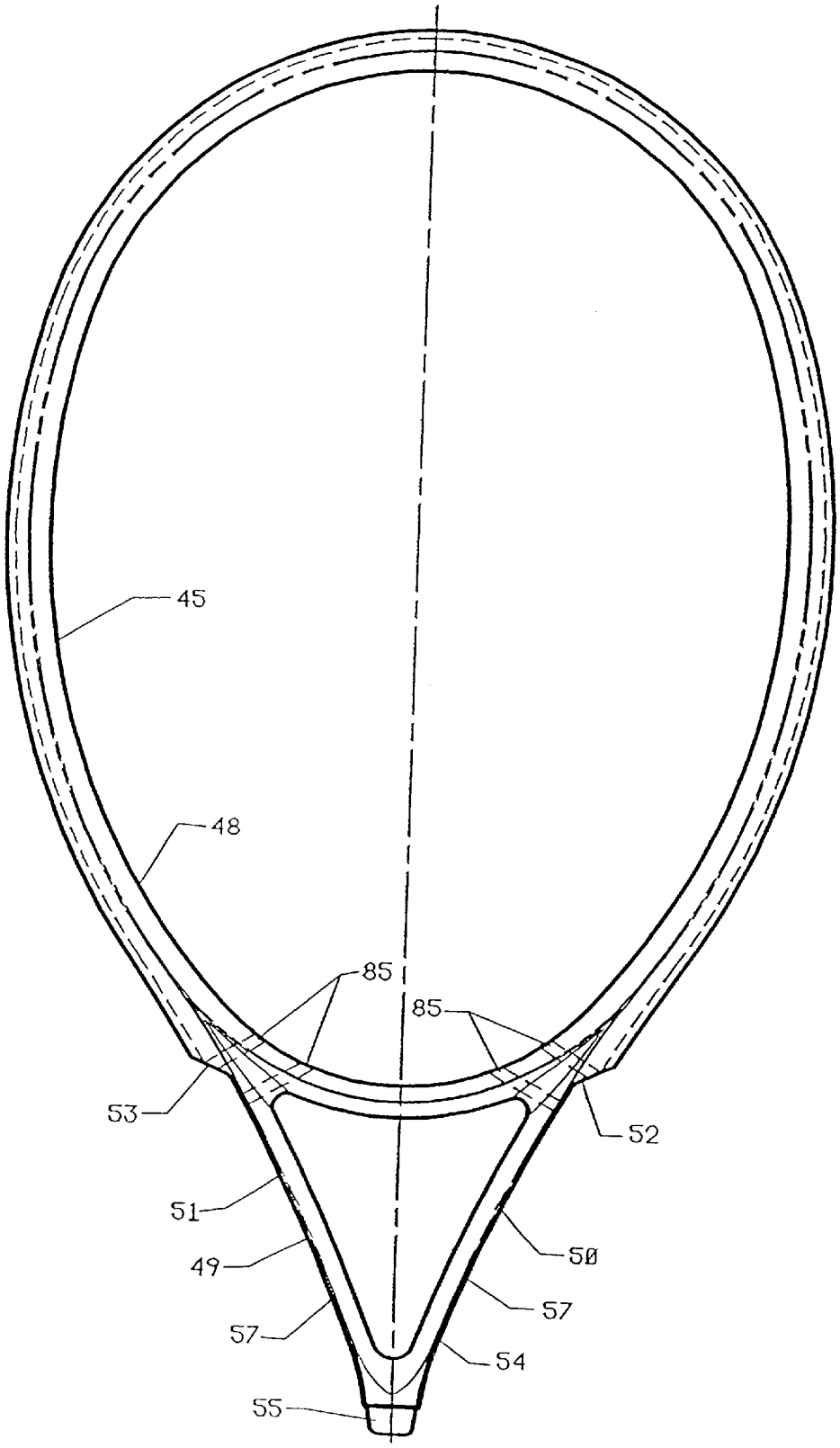
FIG. 5 is a front view of the head portion of the racquet of FIG. 3.
Figure 6:
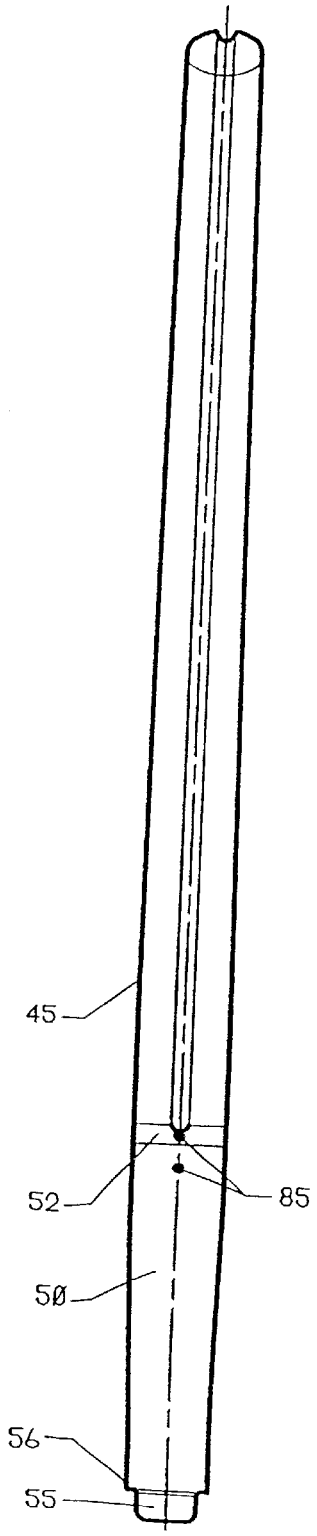
FIG. 6 is a side view of the head portion of FIG. 5.

Referring to FIGS. 5 and 6, the head portion includes a hoop 48 and a V-shaped throat portion 49. The throat portion includes a pair of arms 50 and 51 which extend downwardly from shoulders or undercuts 52 and 53 in the hoop 48 toward the longitudinal centerline CL. The lower ends of the arms are joined by a connecting portion 54, and a tapered projection 55 extends downwardly from the connector 54. Shoulders 56 extend laterally between the projecting 55 and the front and rear faces of the head portion.

Figure 8:
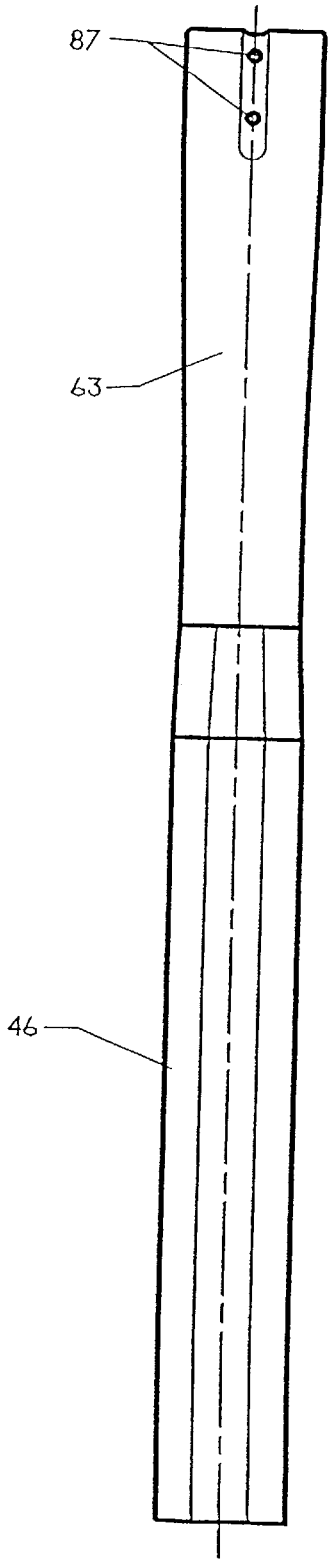
FIG. 8 is a side view of the handle portion of FIG. 7.
Figure 7:
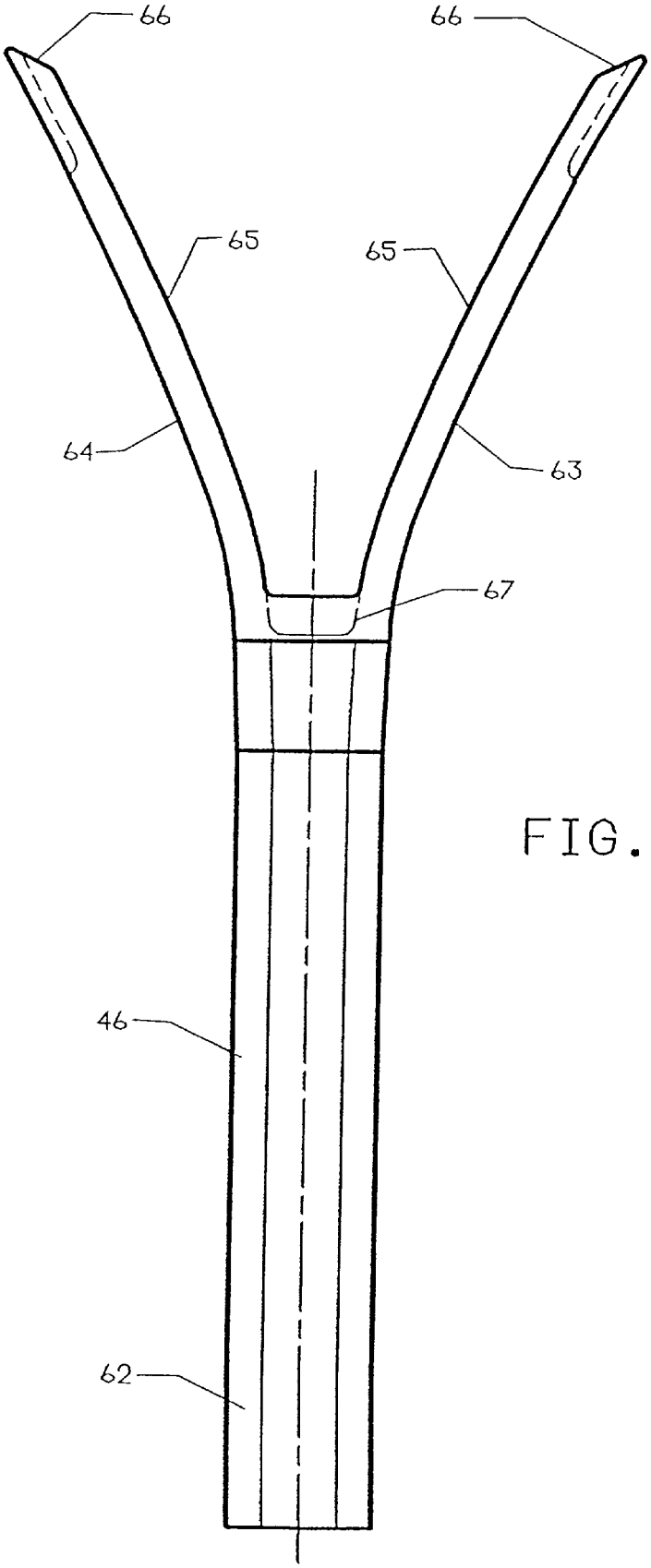
FIG. 7 is a front view of the handle portion of the racquet of FIG. 3.

Referring to FIGS. 7 and 8, the handle portion 46 includes a grip portion 62 and a throat portion which is formed from a pair of diverging arms 63 and 64. Each arm includes an inside surface 65 and an angled upper end 66 which mates with one of the shoulders 52 or 53. A socket 67 extends into the top of the grip portion between the arms 63 and 64.

Figure 10:
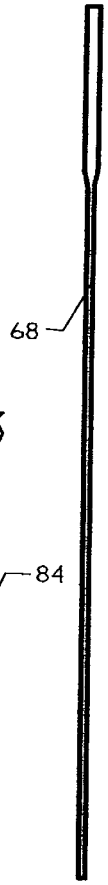
FIG. 10 is a side view of the strip of FIG. 9.
Figure 9:
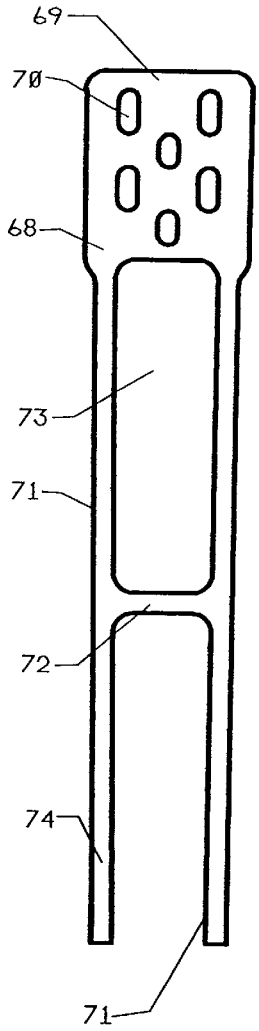
FIG. 9 is a plan view of the strip of shock and/or vibration absorbing material which separates the head and handle portions of FIGS. 5 and 7.

FIGS. 9 and 10 illustrate a panel or sheet 68 of material for absorbing shock and/or vibration which is positioned between the outer surfaces 57 of the throat portion and the inside surfaces 65 of the handle portion. The particular panel illustrated includes a flat end portion 69 which is provided with cutouts or recesses 70 and a pair of elongated parallel strips 71 which are joined by a crosspiece 72. The strips are separated by recesses 73 and 74. The recesses 70, 73, and 74 are intended primarily to reduce the weight of the panel 68. However, the panel could be any shape and could be solid, i.e., without any openings or recesses. Alternatively, the shock and/or vibration absorbing material could be formed from a plurality of separate pieces.

The panel 68 can be formed from any material which provides shock absorbing and/or vibration dampening properties. Such materials include rubber, synthetic or butyl rubber, Kraton rubber, and urethane. One specific embodiment was made from soft chlorobutyl rubber which included filler and oils sufficient to provide a Shore A hardness of 33.

The panel 68 preferably has a Shore A hardness within the range of 0 to 90, more preferably within the range of 20 to 70, and most preferably within the range of 30 to 60. Shore A hardness is measured in accordance with ASTM D-2240-00.

Figure 11:
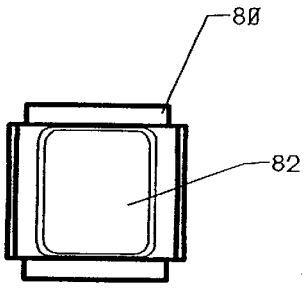
FIG. 11 is a top view of a cap of shock and/or vibration absorbing material which separates the head and handle portions of FIGS. 5 and 7.
Figure 12:
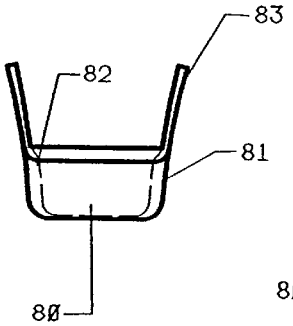
FIG. 12 is a side view of the cap of FIG. 11.
Figure 13:
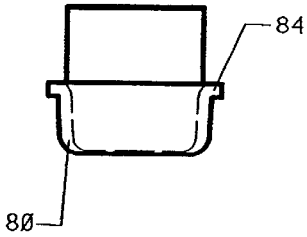
FIG. 13 is a side view of the cap of FIG. 12.
Figure 15:
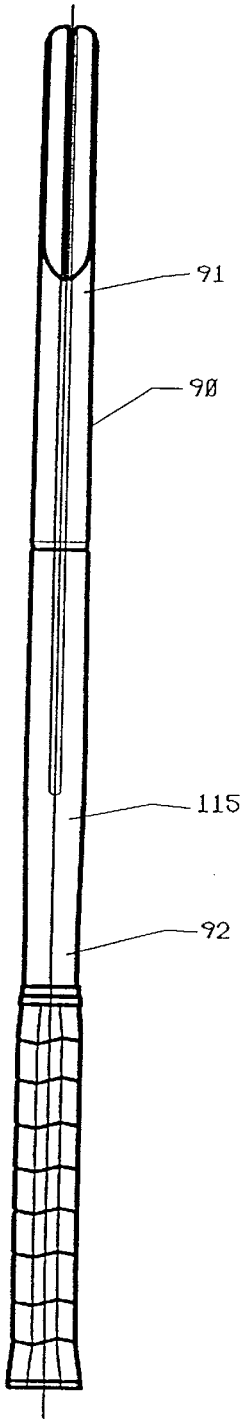
FIG. 15 is a side view of the racquet of FIG. 14.
Figure 14:
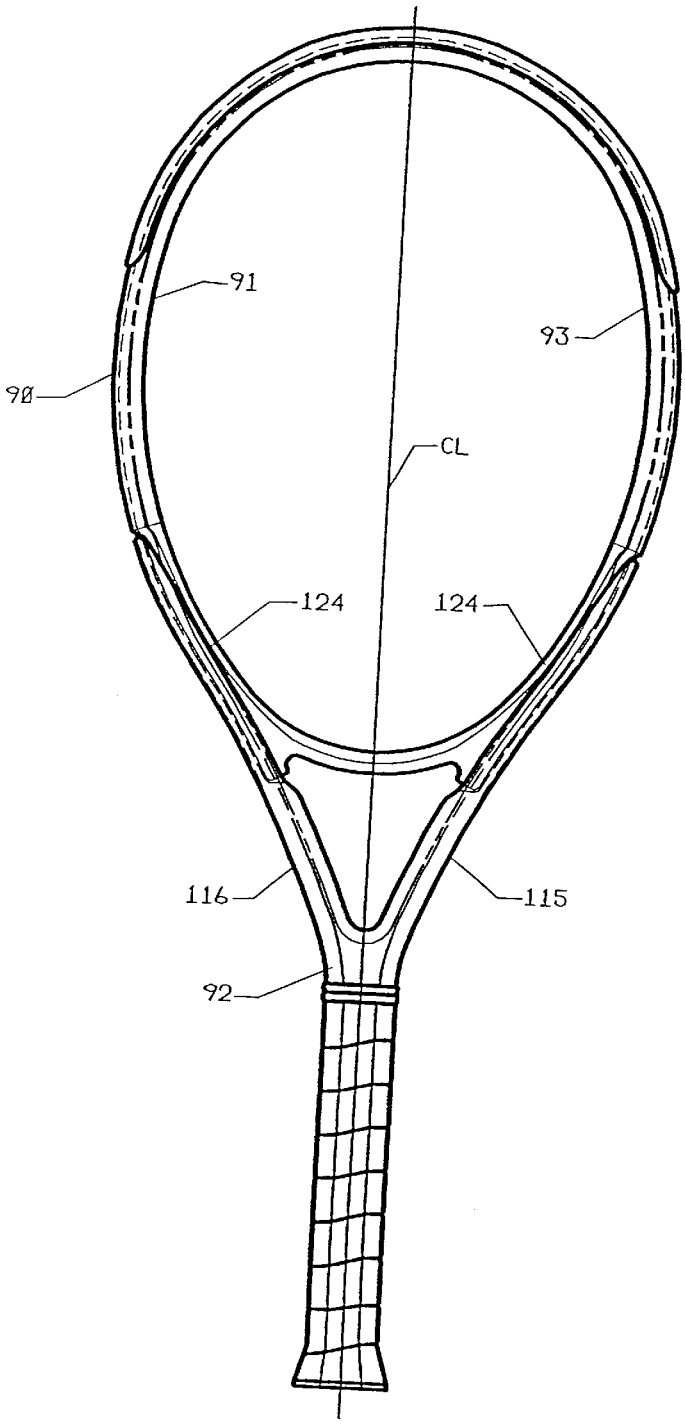
FIG. 14 is a front view of another embodiment of a game racquet which is formed in accordance with the invention.
Figure 16:
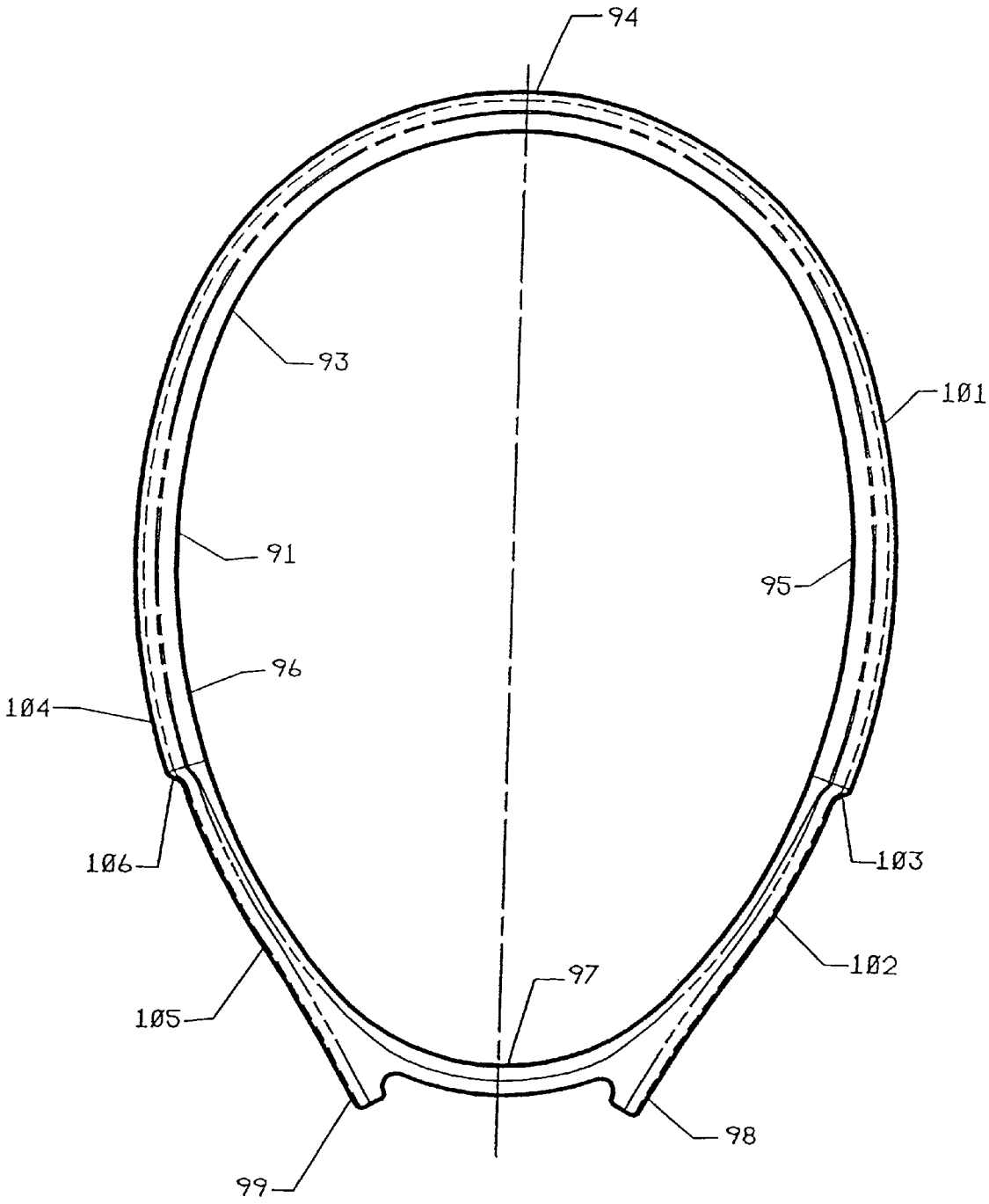
FIG. 16 is a front view of the head portion of the racquet of FIG. 14.
Figure 19:
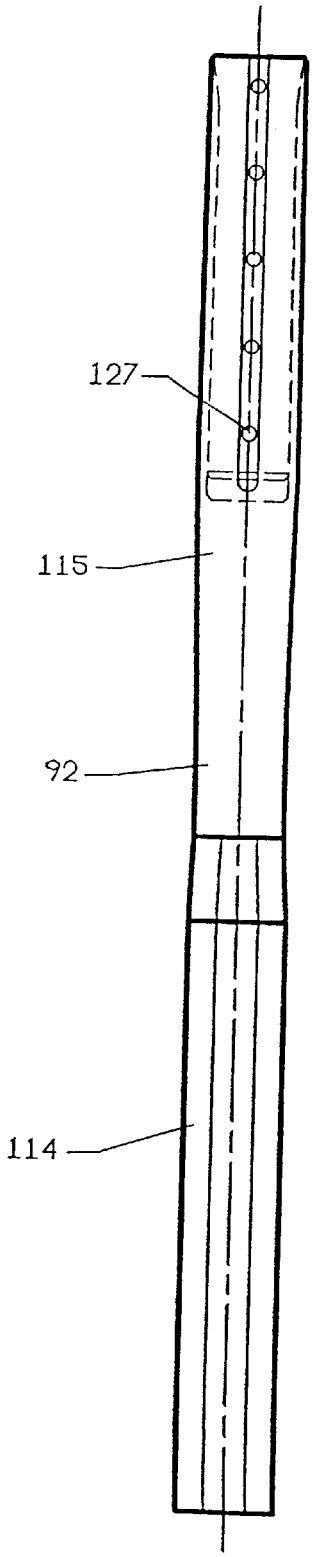
FIG. 19 is a side view of the head portion of FIG. 18.

FIGS. 11–13 illustrate a cup 80 of shock absorbing material which is positioned between the projection 55 of the head portion and the socket 67 of the handle portion. The cup includes a sidewall 81 which has the same dimensions as the socket 67 and a socket 82 which has the same dimensions as the projection 55. Flanges 83 extend upwardly from two sides of the sidewall 81, and flanges 84 extend laterally from the other sides of the sidewall 81.

The cup 80 is attached to both the projection 55 and the socket 67, preferably by adhesive or an adhesive agent which will not separate during normal use of the racquet. The preferred adhesive bonding agent is Loctite 496, which is a Cyanoasrylate Ester adhesive. The flanges 83 extend upwardly between the arms 50 and 51 of the head portion and the arms 63 and 64 of the handle portion. The flanges 84 extend between the top of the socket 67 in the handle portion and the shoulders 56 of the head portion. Similarly, a panel 68 is attached to the outer surface 57 of each of the throat arms 50 and 51 and to the inside surface 65 of each of the handle arms 63 and 64. The strips are also preferably bonded by an adhesive, for example, Loctite 496.

The panels 68 and the cup 80 separate or isolate the head portion from the handle portion so that there is no direct contact between those parts. However, since each part is securely bonded to the panels 68 and the cup 80, the parts are connected together by the panels and cup and will not separate during normal use of the racquet. The panels 68 and cup 80 significantly reduce the transmission of shock and vibration from the head portion to the handle portion.

If desired the projection 55 and socket 67 could be omitted. In that event the cap 80 can be replaced by a suitably shaped piece which prevents direct contact between the head and the handle.

A mechanical connection between the head portion and the handle portion can be provided by the racquet strings. Referring to FIG. 5, the head portion is provided with at least one string hole 85 which extends through the undercuts 52 and 53 of the throat arms 50 and 51. A corresponding string hole 87 (FIG. 8) extends through the upper end of each of the handle arms 63 and 64. The holes 85 and 87 are aligned when the head and handle portions are connected by the panels 66 and cup 80. When the racquet is strung, one of the main strings 37 extends through the holes 85 and 89 on each side of the racquet and further secure the head and handle portions together. The strings extend through the middle recesses 70 in the panels 68. Alternatively, the panels 68 could be shaped so that the strings do not pass through the panels.

The mechanical connection which is provided by the strings is located near the upper ends of the handle arms 63 and 64. The lower ends of the handle arms are therefore free to move slightly relative to the lower ends of the throat arms 50 and 51 as the panels 68 and cup 80 are compressed by forces which are exerted on the racquet. Such relative movement assists in absorbing shock.

It is not necessary to have the racquet strings extend through the head and the handle. The head and handle could be connected solely by the adhesive bond to the vibration and/or shock absorbing material.

FIGS. 14–19 illustrate another embodiment of a racquet 90 which includes a head portion 91 and a handle portion 92 which extends along the centerline CL. The head portion 91 includes a hoop 93 which has a top portion 94, side portions 95 and 96, and a bottom or yoke portion 97. A pair of short throat portions 98 and 99 extend downwardly from the yoke.

Figure 17:
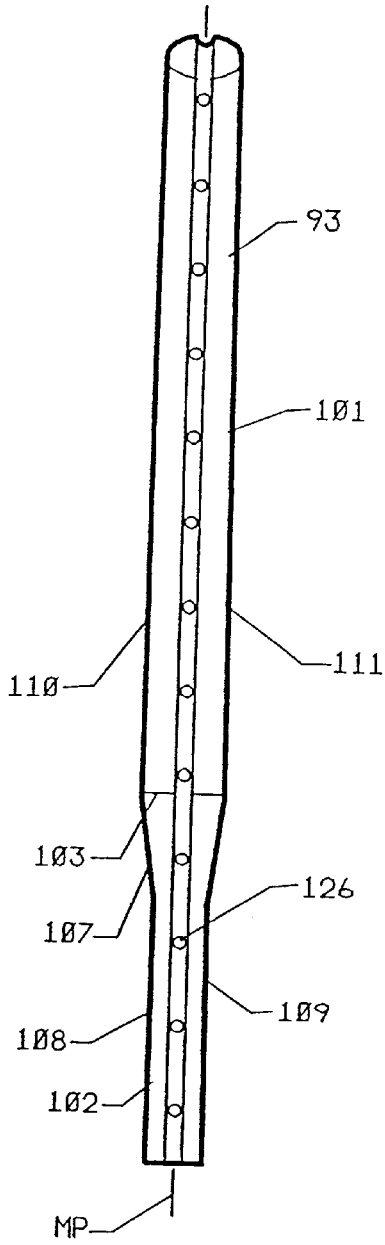
FIG. 17 is a side view of the head portion of FIG. 16.
Figure 18:
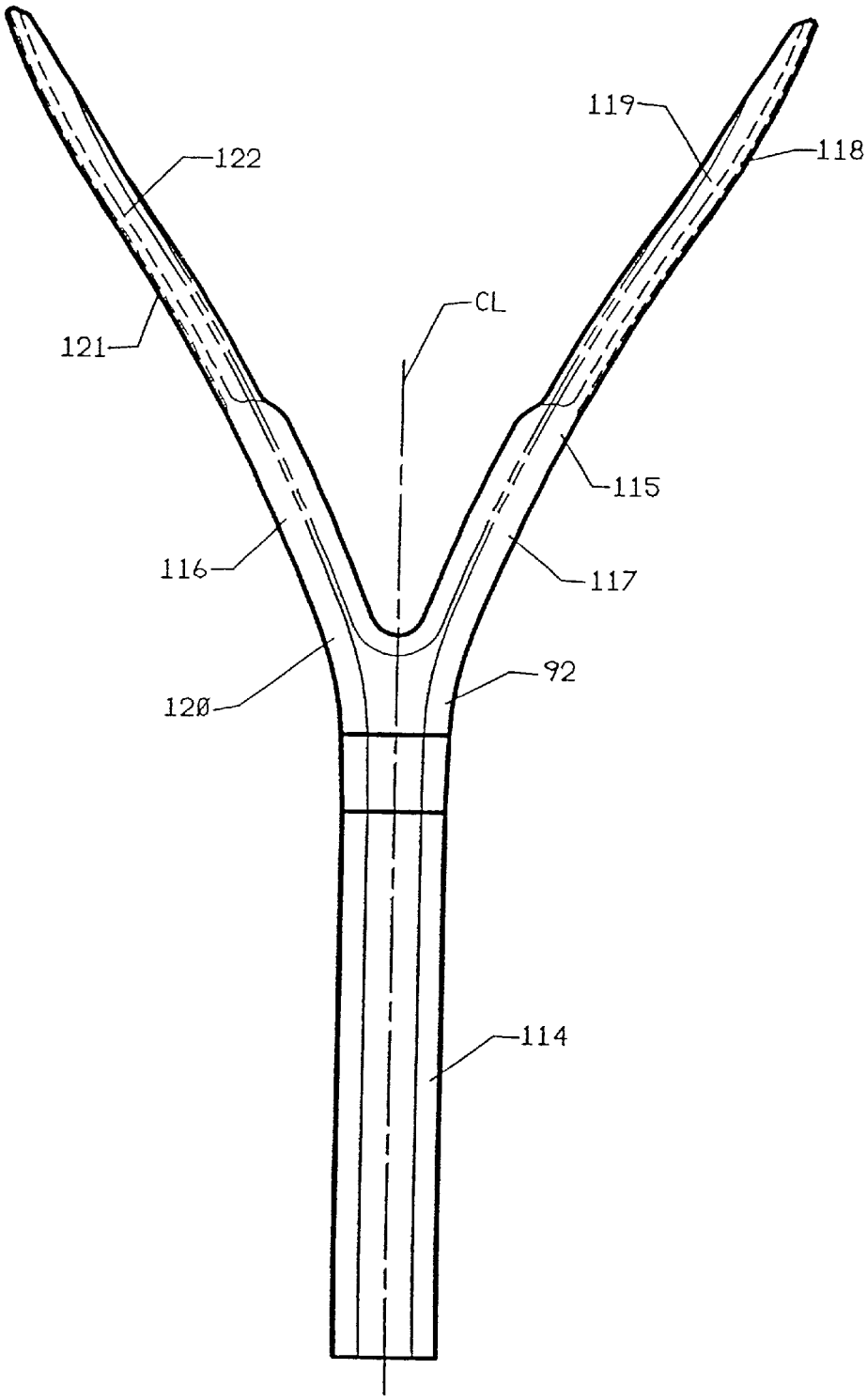
FIG. 18 is a front view of the handle portion of the racquet of FIG. 14.

The side portion 95 includes a first outer edge 101 and a second recessed convex outer surface 102 which extends downwardly from about an undercut 103 at 4:00 o'clock to the end of the throat portion 98. Similarly, the side portion 96 includes a first outer edge 104 and a recessed convex outer surface 105 which extends downwardly from an undercut 106. Referring to FIG. 17, the recessed portions of the sides 95 and 96 taper inwardly at 107 so that the top and bottom edges 108 are offset toward the midplane MP from the top and bottom edges 110 and 111 of the remainder of the head.

The handle portion 92 includes a grip portion 114 and a throat formed by a pair of diverging arms 115 and 116 which extend away from the centerline CL. The arm 115 includes a lower portion 117 which has a concave inside surface 119 which mates with the convex outer surface 102 of the head. The arm 116 similarly includes a lower portion 120 and an upper portion 121 which has a concave inside surface 12 which mates with the convex surface 105 of the head.

A panel 124 of shock and/or vibration absorbing material is inserted between each of the arms 115 and 116 and the head and secured by a chemical or an adhesive bond. Each panel 124 is preferably similar to the panel 68 and is secured by Loctite 496 to both the head and handle portions. The panels isolate the head and handle portions A plurality of string holes 126 (FIG. 17) are provided in the recessed side portions 102 and 105, and a plurality of string holes 127 (FIG. 19) are provided in the upper portions 118 and 120 of the arms of the handle portion. Strings which extend through the string holes 126 and 127 provide an additional mechanical attachment between the head and the handle.

If desired, the arms 115 and 116 of the handle portion can extend upwardly for a greater distance along the sides of the head portion. Also, the short throat portions 98 and 99 of the head can be omitted if desired. The head portion can be entirely hoop-shaped, and the arms of the handle portion can follow the contour of the hoop for any portion of the head which is desired. The handle portion can also extend along the centerline of the racquet up to the head portion so that the racquet does not have an open throat between the head and the handle.

While in the foregoing specification a detailed description of specific embodiments of the invention has been set forth for the purpose of illustration, it will be understood that many of the details hereingiven can be varied considerably by those skilled in the art without departing from the spirit and scope of the invention.

We claim:

1. A game racquet comprising:

a one-piece head portion including a hoop and a throat portion, the throat portion integrally connected to and outwardly extending from the hoop;

a handle portion formed separately from the head portion, the head and handle portions formed of substantially the same material; and shock and/or vibration absorbing material positioned between the head portion and the handle portion, the head portion and the handle portion being secured to the absorbing material, the absorbing material being positioned between the throat portion and the handle portion and also positioned between the hoop and the handle portion.

2. The racquet of claim 1, wherein the absorbing material is formed of a material selected from the group consisting of natural rubber, synthetic rubber, butyl rubber, urethane, and combinations thereof.

3. The racquet of claim 1, wherein the head and handle portions are each formed of a material selected from the group consisting of a thermoplastic, a thermoset material and combinations thereof.

4. The racquet of claim 1, wherein the head and handle portions are each formed of a graphite and resin composite.

5. The racquet of claim 1, wherein the hoop and the handle portion are secured to the absorbing material by adhesive.

6. The racquet of claim 1, wherein the throat portion is V-shaped.

7. The racquet of claim 1, wherein each of the head portion and the handle portion directly contact the absorbing material.

8. A game racquet having a string bed including main and cross strings, the racquet comprising:

a head portion including a hoop having an outer periphery;

a handle portion formed separately from the head portion; and shock and/or vibration absorbing material disposed between and directly connecting the head portion and the handle portion at at least one location about the outer periphery of the hoop, the at least one location generally extending at a position toward the handle portion and beneath the lowest cross string when viewed with the racquet positioned vertically and the head portion generally positioned above the handle portion.

9. The racquet of claim 8, wherein the head portion includes a throat portion outwardly extending from the outer periphery of the hoop.

10. The racquet of claim 8, wherein the at least one location includes two or more spaced apart locations about the outer periphery of the hoop.

11. The racquet of claim 9, wherein the absorbing material is also disposed between the throat portion and the handle portion.

12. The racquet of claim 8, wherein the hoop and the handle portion are secured to the absorbing material by adhesive.

13. The racquet of claim 8, wherein the absorbing material is formed of a material selected from the group consisting of natural rubber, synthetic rubber, butyl rubber, urethane, and combinations thereof.

14. A game racquet comprising:

a head portion including a hoop having a top portion, first and second side portions and a bottom portion, the first side portion having a first top segment, a first middle segment and a first bottom segment, the second side portion having a second top segment, a second middle segment and a second bottom segment;

a handle portion formed separately from the head portion; and shock and/or vibration absorbing material disposed between the head portion and the handle portion at only the bottom portion, the first bottom segment and the second bottom segment.

15. The racquet of claim 14, wherein the head portion includes a throat portion outwardly extending from the outer periphery of the hoop.

16. The racquet of claim 15, wherein the absorbing material is also disposed between the throat portion and the handle portion.

17. The racquet of claim 14, wherein the hoop and the handle portion are secured to the absorbing material.

18. The racquet of claim 14, wherein the hoop and the handle portion are secured to the absorbing material by adhesive.

19. The racquet of claim 14, wherein the absorbing material is formed of a material selected from the group consisting of natural rubber, synthetic rubber, butyl rubber, urethane, and combinations thereof.

20. A game racquet having a string bed including main and cross strings, the racquet comprising:

a head portion including a hoop having an outer periphery;

a handle portion formed separately from the head portion; and shock and/or vibration absorbing material disposed between the head portion and the handle portion at two or more spaced apart locations about the outer periphery of the hoop, the at least two locations generally located toward the handle portion and beneath the lowest cross string, when viewed with the racquet positioned vertically and the head portion generally positioned above the handle portion.

21. The racquet of claim 20, wherein the head portion includes a throat portion outwardly extending from the outer periphery of the hoop.

22. The racquet of claim 20, wherein the absorbing material is also disposed between the throat portion and the handle portion.

23. The racquet of claim 20, wherein the absorbing material is formed of a material selected from the group consisting of natural rubber, synthetic rubber, butyl rubber, urethane, and combinations thereof.

24. A game racquet comprising:

a head portion including a hoop having a top portion, first and second side portions and a bottom portion, the first side portion having a first top segment, a first middle segment and a first bottom segment, the second side portion having a second top segment, a second middle segment and a second bottom segment;

a handle portion formed separately from the head portion; and shock and/or vibration absorbing material disposed between the head portion and the handle portion at at least one location on at least one of the bottom portion, the first bottom segment and the second bottom segment, the first and second top segments and the first and second middle segments being free of contact with the shock and/or vibration absorbing material.

25. The racquet of claim 24, wherein the absorbing material is disposed between the head and handle portions at the first and second bottom segments.

26. The racquet of claim 24, wherein the absorbing material is disposed between the head and handle portions at the bottom portion and at the first and second bottom segments.

27. The racquet of claim 24, wherein the head portion includes a throat portion outwardly extending from the outer periphery of the hoop.

28. The racquet of claim 24, wherein the absorbing material is formed of a material selected from the group consisting of natural rubber, synthetic rubber, butyl rubber, urethane, and combinations thereof.

* * * * *